US007228654B2

(12) United States Patent
Stravitz

(10) Patent No.: US 7,228,654 B2
(45) Date of Patent: Jun. 12, 2007

(54) DISPLAY FRAME WITH SIDE EDGE ENGAGEMENT MEMBERS

(76) Inventor: David M. Stravitz, 16 Park Ave. - Suite 14A, New York, NY (US) 10016

( * ) Notice: Subject to any disclaimer, the term of this patent is extended or adjusted under 35 U.S.C. 154(b) by 127 days.

(21) Appl. No.: 10/717,285

(22) Filed: Nov. 19, 2003

(65) Prior Publication Data

US 2005/0102877 A1 May 19, 2005

(51) Int. Cl.
*G09F 1/12* (2006.01)

(52) U.S. Cl. ..... 40/781; 40/732; 40/737

(58) Field of Classification Search ..... 40/781, 40/734, 737, 661, 606.18, 611.05, 764
See application file for complete search history.

(56) References Cited

U.S. PATENT DOCUMENTS

| | | | | |
|---|---|---|---|---|
| 2,402,717 | A | 6/1946 | Winer | |
| D183,774 | S | 10/1958 | Stefanakis | |
| 2,952,431 | A | 9/1960 | Pedley | |
| D196,368 | S | 9/1963 | Isaia | |
| D198,853 | S | 8/1964 | Hoshour | |
| 3,918,187 | A * | 11/1975 | Vogele | 40/781 |
| 4,065,091 | A | 12/1977 | Ulrich | |
| 4,212,122 | A * | 7/1980 | Reim | 40/757 |
| 4,296,561 | A * | 10/1981 | Lawrence | 40/772 |
| D278,496 | S | 4/1985 | Hausman | |
| 4,594,802 | A * | 6/1986 | Field | 40/661 |
| 4,980,982 | A * | 1/1991 | Verdon et al. | 40/777 |
| 5,109,619 | A * | 5/1992 | Noggle | 40/737 |
| 6,209,248 | B1 * | 4/2001 | Reinhard | 40/768 |
| 6,412,743 | B1 * | 7/2002 | Fell | 248/441.1 |
| D476,818 | S | 7/2003 | Stravitz | |
| D488,627 | S | 4/2004 | Stravitz | |

OTHER PUBLICATIONS

Display Innovations in Acrylic, p. 4, Sign holder at top and center, copy in design library.
U.S. Appl. No. 29/199,491, filed Feb. 13, 2004; Inventor: Stravitz, David.
U.S. Appl. No. 29/209,657, filed Jul. 19, 2004; Inventor: Stravitz, David.
U.S. Appl. No. 29/209,656, filed Jul. 19, 2004; Inventor: Stravitz, David.
U.S. Appl. No. 29/219,014, filed Dec. 10, 2004; Inventor: Stravitz, David.
U.S. Appl. No. 10/014,061, filed Dec. 15, 2004; Inventor: Stravitz, David.

* cited by examiner

*Primary Examiner*—Cassandra Davis
(74) *Attorney, Agent, or Firm*—Frishauf, Holtz, Goodman, & Chick, P.C.

(57) ABSTRACT

A frame assembly for pictures or other objects to be displayed includes a frame having front and rear panels defining a space therebetween for receiving objects to be displayed. A support mechanism optionally provided for supporting the frame in a substantially upright position enabling pictures to be viewed through a transparent area or window formed in one or both of the front and rear panels. The front panel includes retaining members formed along edges thereof, including at least two opposed edges, and each retaining member includes an extension portion extending rearward relative to a planar portion of the front panel and an inwardly projecting ridge formed on an inward surface of the extension portion. The rear panel is designed to fit snugly between the ridges and a rear surface of the front panel. The support mechanism may be a base separable from the frame or formed integral with the rear panel. The frame assembly may also be configured as an intermediate panel having retaining members extending forwardly and rearwardly thereof, with respective front and rear panels engageable therewith.

44 Claims, 12 Drawing Sheets

DISPLAY FRAME WITH SIDE EDGE ENGAGEMENT MEMBERS

FIELD OF THE INVENTION

The present invention relates generally to picture frames and display frames or holders, and more particularly to picture/display frames or holders which include an integral mechanism for securely retaining pictures therein in order to prevent movement of the pictures or other items held in the frame or holder. The present invention also relates to picture/display frames or holders having front and rear members with quick connect/quick disconnect engagement members.

BACKGROUND OF THE INVENTION

The term "picture frame" is used herein to refer to a picture or display frame or holder for holding and displaying virtually any type of substantially flat item. The term "picture frame" is used for convenience of description.

There are numerous different types of picture frames known in the art. Some picture frames include a holder defining a periphery of the frame, a clear front window arranged in the holder and a rear panel removably attached to the holder behind the front window. The rear panel usually includes a support, such as a prop or wall mounting mechanism, to enable the frame to be supported on a support surface or hung on a wall. A picture is placed in the frame by removing the rear panel from attachment to the holder, placing a picture against the front window and then attaching the rear panel to the holder.

Other picture frames have a unitary structure and are designed to provide a lower support which can rest on a planar support surface. One type of these unitary frames includes a planar support wall, a front panel defining a clear window extending rearward from a forward longitudinal edge of the planar support wall and a rear panel having an upper edge connected to an upper edge of the front panel and biased against the rear surface of the front panel. Another type of these unitary frames are formed with a front and rear base portion, a front panel extending upward from a rear edge of the front base portion and a rear panel extending upward from a front edge of the rear base portion and having an upper edge connected to the upper edge of the front panel. The rear and front panels are biased against one another. A picture is placed between the front and rear panel and retained therein by the bias of the rear panel against the front panel.

For wall-mounting applications, unitary picture frames are formed with a rear panel including one or more apertures and a front panel having a lower edge connected to a lower edge of the rear panel so that pictures can be placed between the front and rear panels. Screws and the like are inserted through the apertures in the rear panel to attach the frame to a wall.

A problem with these types of picture frames is that the size of the frame allows it to retain only the same size picture in the same orientation as the frame. Thus, if the frame is designed for an 8×10 picture in the portrait more, it cannot be used for a smaller picture, because the picture would move around, and cannot be used for an 8×10 picture in the landscape mode, because the edges of the picture would extend beyond the edges of the frame. Thus, these types of frames have very limited capabilities.

OBJECTS AND SUMMARY OF THE INVENTION

It is an object of the present invention to provide new and improved display frames or holders for holding and displaying pictures or other objects.

It is another object of the present invention to provide new and improved display frames or holder which include an integral quick connect/quick disconnect mechanism for securely retaining pictures or other items therein in order to prevent movement of the pictures even when the edges of the pictures or other item being displayed are not supported by edges of the display frame or holder.

It is yet another object of the present invention to provide new and improved display frames or holders with each being capable of receiving various sizes of pictures or other items, no greater than a predetermined maximum size, in different orientations, such as in both the portrait mode and the landscape mode.

In order to achieve these objects and others, a display frame assembly in accordance with the invention comprises a frame including front and rear panels spaced apart to define a space therebetween for receiving an object to be displayed and a support mechanism for supporting the frame in an upright position enabling the object to be displayed to be viewed through a transparent window formed in one or both of the front and rear panels. The front panel includes a securing mechanism which enables the rear panel to be tightly fit to the front panel. Specifically, the front panel has retaining members formed along edges thereof, including at least two opposed edges, and each retaining member includes an extension portion extending rearward relative to a planar portion of the front panel and an inwardly projecting ridge formed on an inward surface of the extension portion. The rear panel is designed to fit snugly between the ridges and a rear surface of the front panel. Thus, the ridges may be spaced from the rear surface of the front panel by a distance substantially equal to or only slightly larger than a thickness of the rear panel such that the rear panel fits between the ridges and the rear surface of the front panel with only a nominal clearance for a thickness of the object to be displayed.

To enable separation of the rear panel from the front panel for inserting or changing objects in the frame, access to the rear panel may be provided by constructing the retaining members such that one or more of the retaining members does not extend across the entire length of the respective edge of the front panel. Rather, the retaining member along this edge is spaced from the retaining members along adjacent edges of the front panel to define access openings which allow access to the rear panel. Separation of the rear panel may be facilitated by fingernail or fingertip grips formed in the rear panel alongside the access openings. When the panels are made of flexible or resilient plastic (such as polycarbonate, polypropylene, polyethylene or the like), separation can be accomplished by flexing the panels to release a corner portion of the engaged panels. Then the panels can be easily disengaged from each other.

The support mechanism may comprise a base defining a channel receivable of an edge portion of the frame, with the frame being removably attachable to the base. One construction of a base in accordance with the invention includes a support wall having a substantially planar lower surface adapted to rest on a support surface and spaced-apart, parallel retaining walls extending upward from an upper surface of the support wall and defining the channel therebetween.

To removably secure the frame to the base, a snap-fit rib may be formed on an inward surface of one of the retaining walls facing the other retaining wall at a position at which it engages a rear edge of the extension portion of a retaining member on the edge portion of the frame when the frame is positioned in the channel. In the alternative, a snap-fit recess may be formed on an inward surface of one of the retaining walls facing the other retaining wall at a position at which it receives the extension portion of the retaining member.

Another construction of a base is substantially semi-cylindrical and comprises a pair of arcuate walls having substantially flat lower edges co-planar with one another and upper edges situated opposite one another to define the channel therebetween, and side walls connected to lateral edges of the arcuate walls. The side walls have substantially flat lower edges co-planar with the lower edges of the arcuate walls to provide a flat support surface to enable the base to be supported on a planar support. To mate with the frame, the side walls each include a cut-out arranged to accommodate the edge portion of the frame. A snap-fit portion of each cut-out may be provided to receive the ridge and an adjoining portion of the extension portion of one of the retaining members in the edge portion of the frame when the edge portion of the frame is positioned in the channel.

The support mechanism can also be formed integral with the rear panel. For example, the rear panel may include one or more props along a respective side thereof. Each prop is pivotable about a fold or score line between a first position in which it is situated between the ridge of a retaining member and the rear surface of the front panel and a second position apart from the front panel to define a contact point support at a distance from the front panel. The props may include a cut-out to enable pivotal movement thereof from the first position to the second position.

Another integral support mechanism is a wall mount integrally formed in the rear panel, i.e., a projection extending outward from a rear surface of the rear panel. The wall mounts can be formed in addition to or instead of the props.

Another embodiment of a display frame comprises a substantially rectangular rear panel having a score or fold line and which is flexible about the score line to thereby define two substantially rectangular rear panel sections, one on each side of the score or fold line, and a pair of substantially rectangular front panels, each engaged with a respective rear panel section. The front panels have substantially the same form as the front panels of the frames described above, i.e., with retaining members formed along sides thereof but not on the side adjacent to the score or fold line. In this manner, the front panels are slidable over the respective rear panel section relative to the score or fold line. In this embodiment, the retaining members enable the frame to be supported thereby on a support surface.

Another embodiment of a display frame assembly in accordance with the invention comprises a rotatable base and an X-shaped frame removably attached to the base. The frame comprises two frame sections, each including a front panel and a rear panel spaced therefrom to define a space therebetween for receiving an objects to be displayed. One or both of the front and rear panels has a transparent window for viewing the objects to be displayed. The front panel has retaining members formed along edges thereof, including at least two opposed edges, and each retaining member is as described in the frames above.

In this embodiment, the frame sections include cooperating slots to enable them to mate with one another. Specifically, one frame section includes a slot extending upward from a lower edge through both the front and rear panels and the other frame section includes a slot extending downward from an upper edge through both the front and rear panels. Thus, a portion of each frame section above or below the slot slides into the slot of the other frame section.

The base includes pairs of opposed retaining walls, each defining a channel capable of receiving an edge portion of the frame. In one embodiment, to provide rotation to the frame, the base also includes a lower support, and an upper support rotatably coupled to the lower support. The upper and lower supports can rotate relative to one another to display an object mounted in the frame in different rotational positions.

By virtue of the frame assemblies described above, it becomes possible to use a single frame assembly for various sizes of objects to be displayed, since the rear panel fits tightly against the front panel so as to tightly secure the object to be displayed between the front and rear panels, and in various orientations such as portrait mode and landscape mode.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
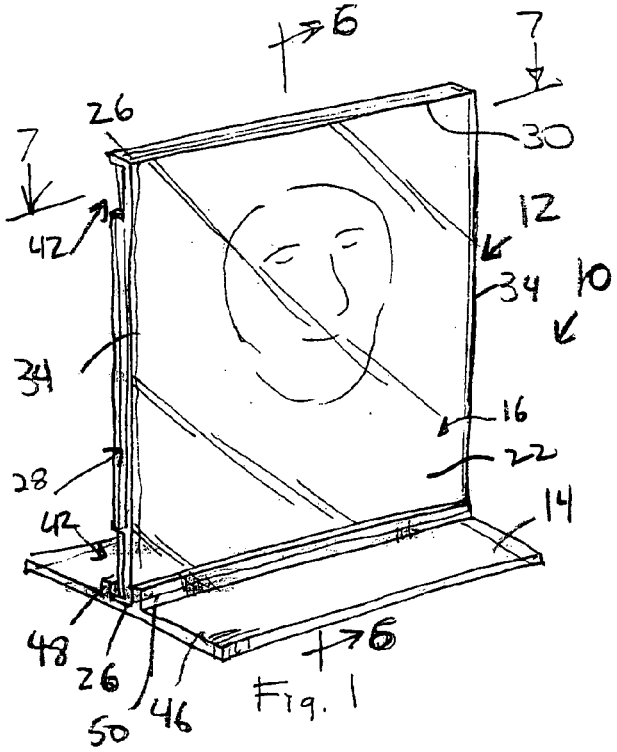
FIG. 1 is a front perspective view of a frame in accordance with the invention shown in a portrait mode in a detachable base.

As indicated hereinabove, the following detailed description is given for a picture frame, it being clear that a frame or holder for other items to be displayed is included within the scope of the present invention. Pictures are referred to for ease of description.

Referring first to FIGS. 1-9, a first embodiment of a frame assembly in accordance with the invention is designated generally as 10 and comprises a frame 12 and a base 14. The base 14 detachably receives the frame 12 so that the frame 12 can be removed from engagement with the base 14, e.g., to insert or replace pictures in the frame 12.

Frame 12 comprises a front panel 16 and a rear panel 18 spaced from the front panel 16 to define a space 20 therebetween capable of receiving one or more pictures 8. The front panel 16 has a transparent planar portion 22 defining a viewing window through which the pictures arranged in the space 20 between the front and rear panels 16, 18, and facing the front panel 18, will be visible. The rear panel 18 may also have a transparent planar portion 24 defining a viewing window so that pictures can be placed in the space 20 in the frame 12 facing both forward and rearward and be visible through either the front panel 16 or the rear panel 18 (see FIG. 4 wherein two pictures are placed in the space 20 between the front and rear panels 16, 18, one facing the front panel 16 and the other facing the rear panel 18). In the alternative, only the rear panel 18 can be provided with a transparent planar portion defining a viewing window.

Figure 2:
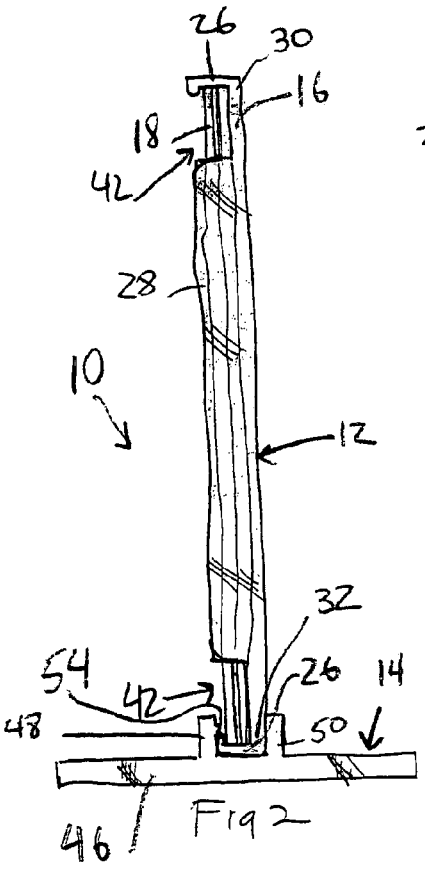
FIG. 2 is a left side elevational view of the frame in the base shown in FIG. 1.
Figure 3:
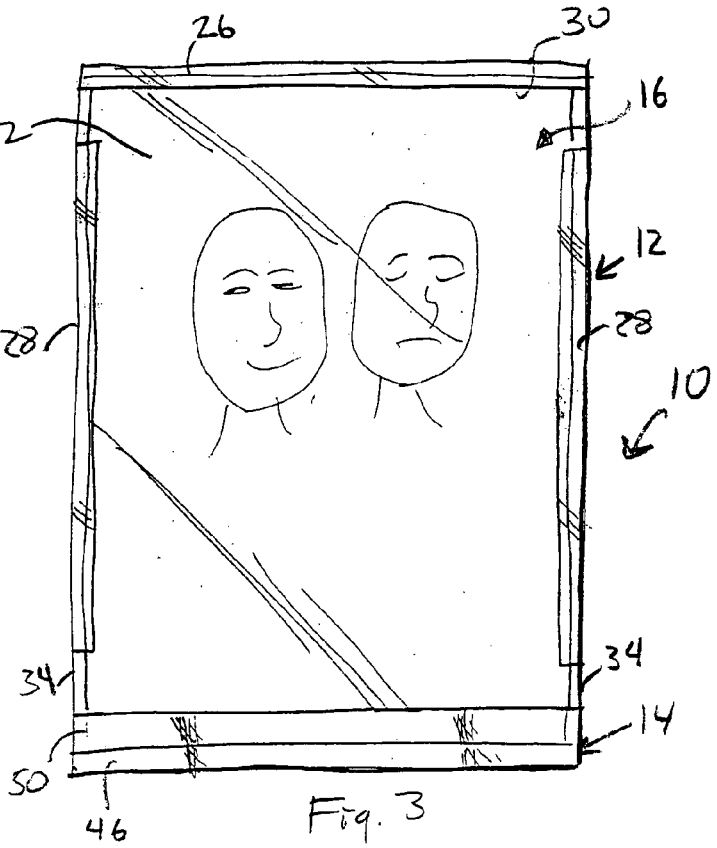
FIG. 3 is a front elevational view of the frame in the base shown in FIG. 1.
Figure 4:
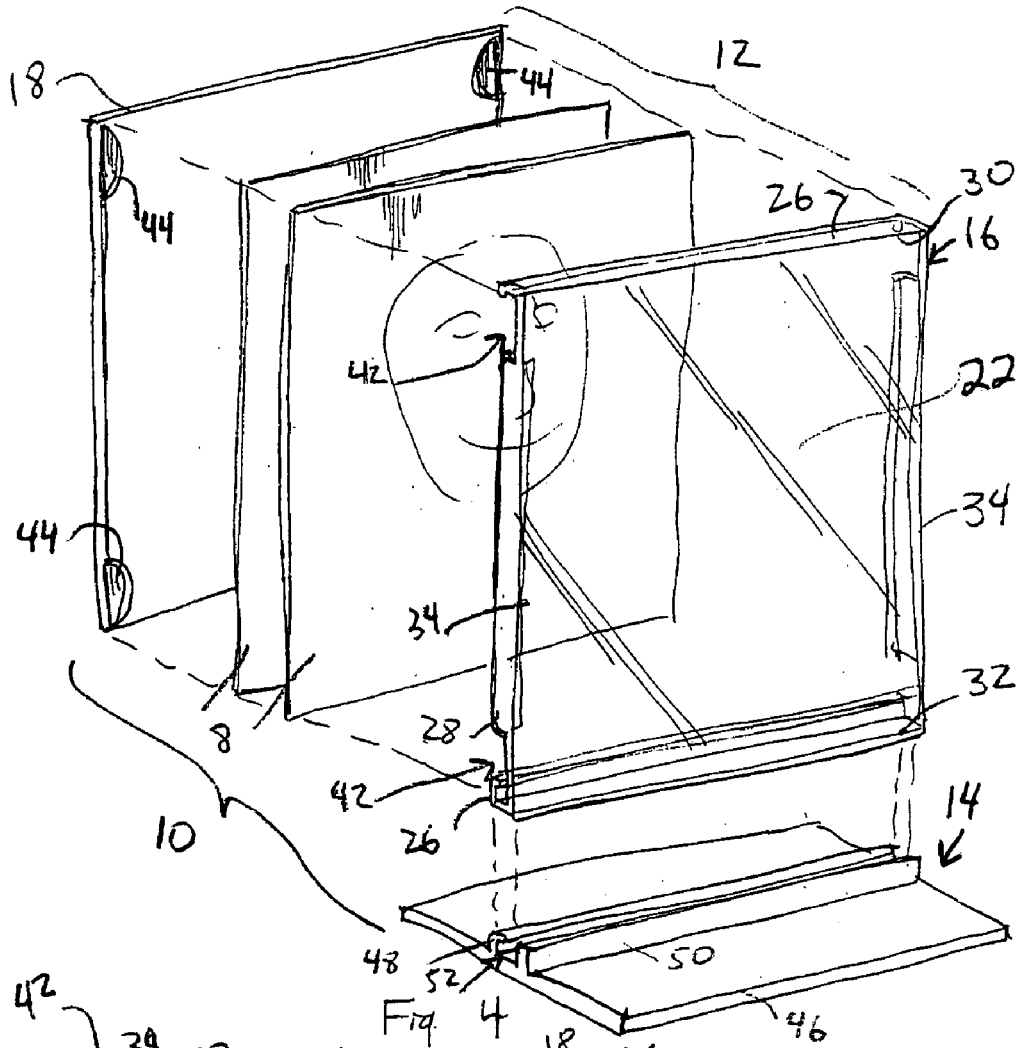
FIG. 4 is an exploded perspective view of the frame in the base shown in FIG. 1.

The frame 12 in accordance with the invention has a unique retaining mechanism which causes the front and rear panels 16, 18 to be securely retained in connection with one another to press any pictures therebetween and prevent movement of the pictures. Specifically, with reference to the frame 12 as shown in FIGS. 1-3, the front panel 16 includes engagement or retaining members 26 extending across the entire upper and lower edges 30, 32 of the planar portion 22 and engagement or retaining members 28 extending across only a middle portion of the lateral edges 34 of the planar portion 22. Retaining members 26, 28 each include an extension portion 36 extending rearward and substantially perpendicular to the respective planar portion 22 and a ridge 38 extending inward from the rear edge of the extension portion 36 (see FIGS. 6 and 7). Ridge 38 may be substantially coextensive with the extension portion 36 as shown.

To ensure that pictures are securely retained in the space 20 between the front and rear panels 16, 18, the ridges 38 are spaced from the rear surface 40 of the front panel 16 by a distance substantially equal to or only slightly larger than the thickness of the rear panel 18. As such, the rear panel 18 fits snugly between the ridges 38 and the rear surface 40 of the front panel 16 with only a nominal clearance for the thickness of the pictures (see FIGS. 6 and 7 wherein the thickness of the pictures is slightly exaggerated for illustration purposes only).

In the illustrated embodiment, the retaining members 26, 28 are designed to enable the rear panel 18 to be easily separated from the front panel 16. To this end, the retaining members 28 formed on the lateral edges 34 of the front panel 16 do not extend across the entire length of the lateral edges 34 of the front panel 16. Rather, as shown in FIG. 2, the retaining members 28 are distanced or spaced from the upper and lower edges 30, 32 of the front panel 16 a sufficient distance to allow access to the rear panel 18 for the purpose of enabling the rear panel 18 to be lifted, peeled or pried away from the front panel 16. Access openings 42 are thus formed along the lateral edges 34 of the front panel 16 of the frame 12. Adjacent the access openings 42, the rear panel 18 is preferably formed with fingernail or fingertip grips 44, the purpose of which is explained below (see FIGS. 4 and 9).

Instead of forming the access openings 42 between the retaining members 28 and the upper and lower edges 30, 32 of the front panel 16, it is possible to form a space between the retaining members 26 and the lateral edges 34 of the front panel 16. Alternately, some access openings can be formed along the upper and/or lower edges 30, 32 of the front panel 16 and some along the lateral edges 34 of the front panel 16.

The front and rear panels 16, 18, when made of a flexible or resilient material such as polycarbonate, polypropylene, polyethylene or the like, can be separated by grasping the side edges 34 and twisting or flexing the unit until one corner becomes disengaged. Then, all of the remaining edge portions can be easily disengaged by the user.

When the frame 12 is used in combination with the base 14, the base 14 may take various self-standing forms in order to orient the frame 12 in a vertical orientation. In the embodiment illustrated in FIGS. 1-9, the base 14 has a support wall 46 having a substantially planar lower surface which is designed to rest on a support surface, such as the surface of a desk, table and the like, to support the frame 12 in a vertical, upright position. Two parallel retaining walls 48, 50 are formed extending upward from the upper surface of the support wall 46 to receive an edge of the front panel 18 of the frame 12 in a channel 52 defined therebetween.

Preferably, the edges of the front panel 16 of the frame 12 and the retaining walls 48, 50 are designed to enable the frame 12 to be securely yet removably fastened into the channel 52 defined between the retaining walls 48, 50. To this end, a snap-fit rib 54 may be formed on an inward surface of one of the retaining walls 48 at a position at which it engages the rear edge of the extension portion 36 of the retaining member 30 on one edge of the front panel 16 when the edge of the front panel 16 is positioned in the channel 52 to thereby secure the front panel 16 between the rib 54 and the upper surface of the base 14 (see FIG. 6). To remove the frame 12 from the base 14, the frame is pivoted about the engaged ridge 38 and rib 54 (to the left in FIG. 6). Instead of a snap-fit rib 54, it is also possible to provide a snap-fit recess such as described below.

To insert or change pictures or other items to be arranged or displayed in the frame 12, the frame 12 would be separated from the base 14 and the front and rear panels 16, 18 would be removed from engagement with one another. This may be achieved by placing a finger in an access opening 42 with holding the retaining members 30, 32, 34 adjacent to the access opening 42 and with a fingernail or fingertip preferably in the associated fingernail or fingertip grip 44. By lifting the rear panel 18 upward away from the front panel 16 and pressing the adjacent retaining members 26, 28 downward, the rear panel 18 can be separated from the front panel 16 (these movements being represented by the arrows in FIGS. 8 and 9). The edges of the rear panel 18 are gradually removed from engagement with the retaining members 26, 28 as the separation of the rear panel 18 from the front panel 16 progresses, until the rear panel 18 becomes completely free of the front panel 16.

An alternate manner to remove the rear panel 18 from engagement with the front panel 16, when the frame 12 is separated from the base 14, would be to grasp opposed edges 30, 32, 34 of the frame 12, possibly by grasping the retaining members 30, 32, 34 thereat, and flex the frame 12 outward. This would result in the edges of the rear panel 18 adjacent the flexed edges of the frame 12 being separated from the front panel 16 so that continued flexing would cause complete separation of the rear panel 18 from the front panel 16 or enable the rear panel 18 to be grasped and easily removed from engagement with the front panel 16.

The front and rear panels 16, 18 are formed from a resilient material to enable them to flex in order to enable the release of the rear panel 18 from engagement with the front panel 16. Such materials would be readily ascertainable to one of ordinary skill in the art, and may be, for example, polycarbonate, polypropylene, polyethylene, or the like.

Figure 5:
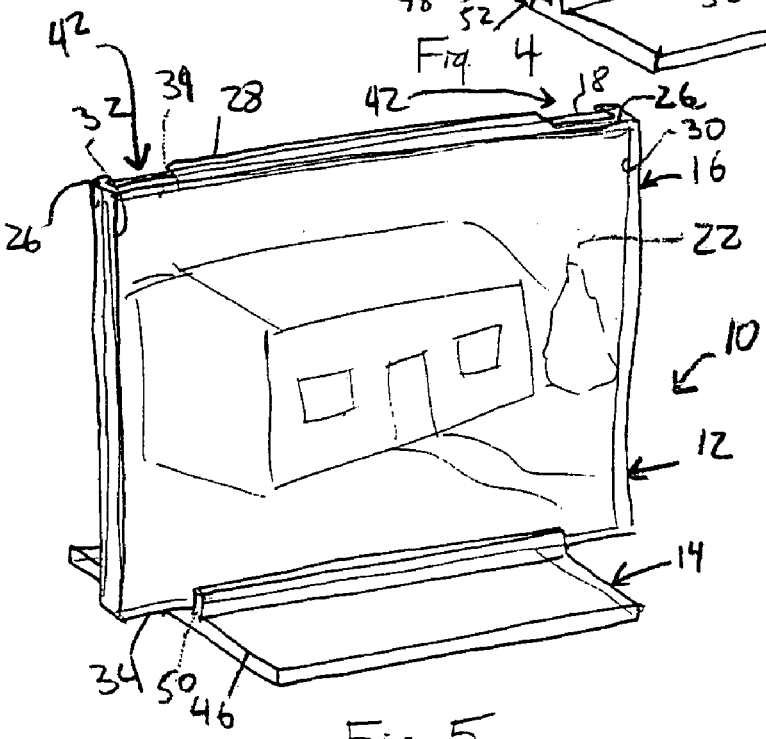
FIG. 5 is a perspective view of the frame rotated 90° with respect to the base and thus shown in a landscape mode the base.
Figure 6:
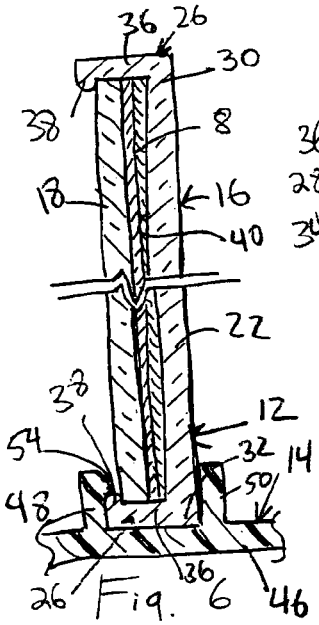
FIG. 6 is a fragmentary cross-sectional view taken along the line 6-6 of FIG. 1.
Figure 7:
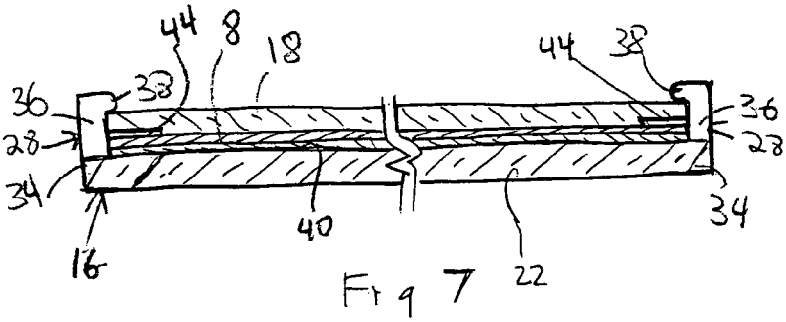
FIG. 7 is a fragmentary cross-sectional view taken along the line 7-7 of FIG. 1.
Figure 8:
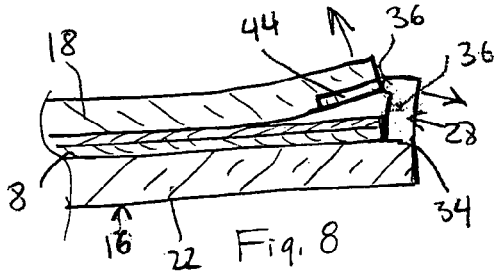
FIG. 8 is a fragmentary enlarged detail view of a portion of FIG. 7 showing the rear panel being removed from the frame.
Figure 9:
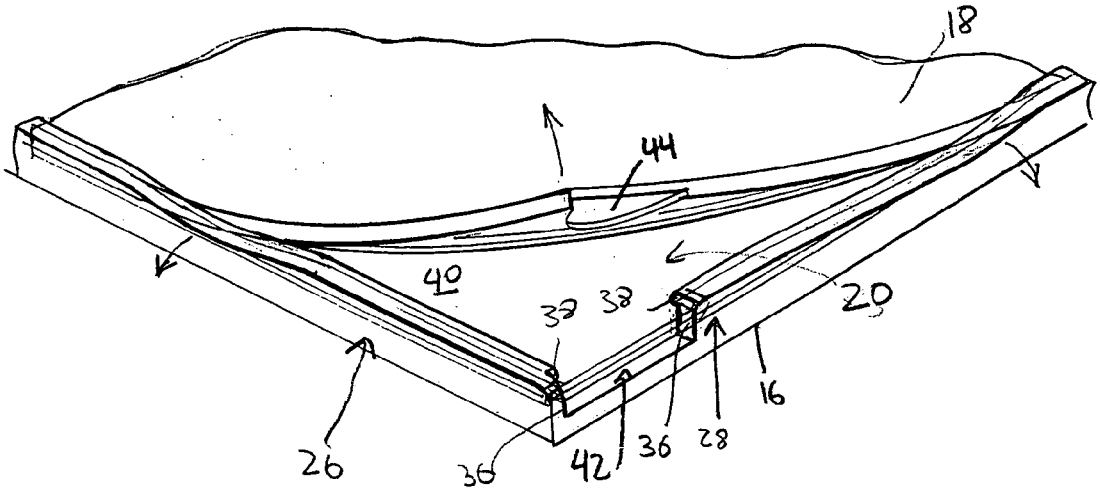
FIG. 9 is a fragmentary rear perspective view on an enlarged scale showing the rear panel of FIG. 8 being further peeled out of the frame.

In the embodiment shown in FIGS. 1-9, the front and rear panels 16, 18 of the frame 12 are rectangular and the upper and lower edges thereof are smaller than the lateral edges thereof. When a smaller upper or lower edge portion of the frame 12 is snap-fit into the channel 52, the frame 12 is positioned in a "portrait mode" as shown in FIG. 1. When a larger lateral edge portion of the frame 12 is snap-fit into the channel 52, the frame 12 is positioned in a "landscape mode" as shown in FIG. 5. Thus, it an advantage of the invention that the same frame can be used for the same size picture in either a portrait or landscape orientation.

Moreover, another advantage of the frame 12 is that the frame 12 can be used for different sizes of pictures, up to the maximum predetermined size of the space 20, since pictures smaller than the predetermined size of the space 20 would be pressed by the rear panel 18 against the front panel 16. The smaller pictures would thus not be able to move within the space 20 and would appear to be "floating" in the frame or display unit.

Any of the constructions of the frame 12 described above can be used in connection with a variety of different bases. Some alternative bases are described below.

Figure 10:
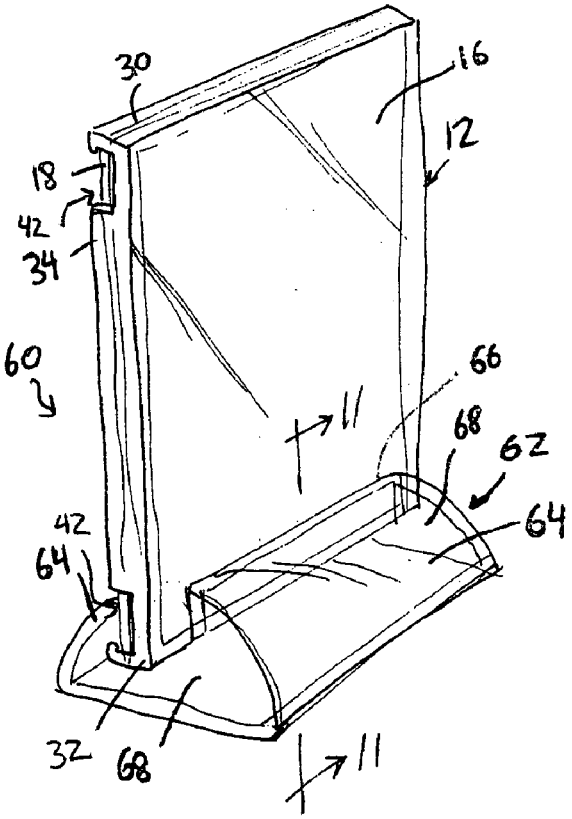
FIG. 10 is a front perspective view of the frame in accordance with the invention shown in a portrait mode in an alternative base.
Figure 11:
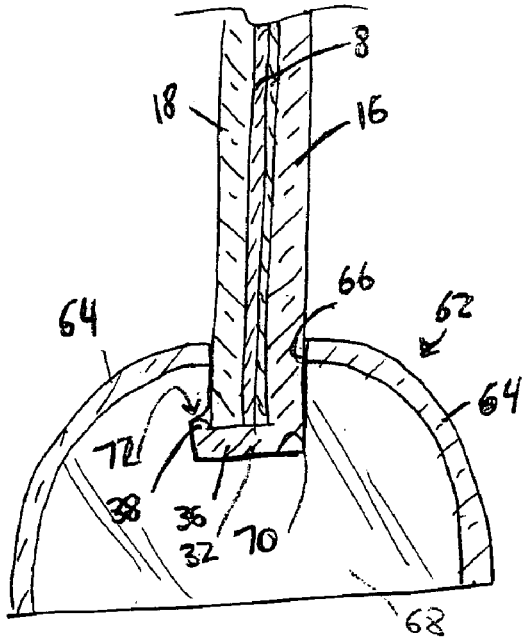
FIG. 11 is a cross-sectional view taken along the line 11-11 of FIG. 10.

Referring now to FIGS. 10 and 11, in this embodiment, the frame assembly 60 includes a frame 12 as described above and a base 62 having a substantially semi-cylindrical form. The base 62 includes a pair of arcuate walls 64 having substantially flat lower edges co-planar with one another and upper edges arranged opposite one another to define a channel 66 therebetween capable of receiving the frame 12. The base 62 also includes side walls 68 connected to the lateral edges of the arcuate walls 64 and which include a substantially flat lower edge co-planar with the lower edges of the arcuate walls 64 to provide a flat support surface to enable the base 62 to be supported on a planar surface of a support.

To removably secure the frame 12 in the channel 66 defined between the upper edges of the arcuate walls 64, the side walls 68 each include a cut-out 70 which accommodates or receives an edge portion of the frame 12. By appropriate shaping of the cut-outs 70, it is possible to provide a secure yet removable attachment of the frame 12 to the base 62. For example, as shown, the cut-outs 70 include a snap-fit portion 72 which receives the extension portion 36 and ridge 38 of the retaining member 30 on the edge portion of the frame 12 when the edge portion of the frame 12 is positioned in the channel 66 to thereby secure the frame 12 in connection with the base 62 (see FIG. 11).

In an alternate embodiment, it is possible to form the front panel 16 with retaining members 30, 32, 34 on all but one side, e.g., on three sides when the frame 12 is rectangular, and construct the cut-outs 70 to receive the edge of the frame 12 without a retaining member. In this case, the cut-outs 70 would be arranged to have the thickness of substantially only the front and rear panels 16, 18. To prevent lateral displacement of the frame 12 from the base 62, the base 62 could be provided with a length equal to or only slightly larger than the edge of the frame 12 without a retaining member and the retaining members on the edges of the front panel 16 adjacent to the edge of the frame 12 without a retaining member extend entirely to the edge of the frame 12 with the retaining member. Displacement of the frame 12 in the base 62 is thus be limited by the retaining members on these adjacent edges.

In this alternate embodiment, in view of the absence of a retaining member along one side of the front panel 16, the rear panel 18 can be removed from engagement with the front panel 16 by sliding the rear panel 18 over the edge of the frame 12 without the retaining member. As such, it would not be necessary to leave any access openings 42 alongside the retaining members, i.e., the retaining members 30, 32, 34 could extend over the entire respective edge of the front panel 16 of the frame 12.

As shown in FIGS. 10 and 11, the frame 12 is rectangular and is positioned in the base 62 in a portrait mode in which a smaller edge of the frame 12 is positioned in the channel 66. However, it is also possible to positioned the frame in the base 62 in a landscape mode in which a larger edge of the frame 12 is positioned in the channel 66. Thus, the same frame and base can be used for the same size picture in either a portrait or landscape orientation.

Figure 12:
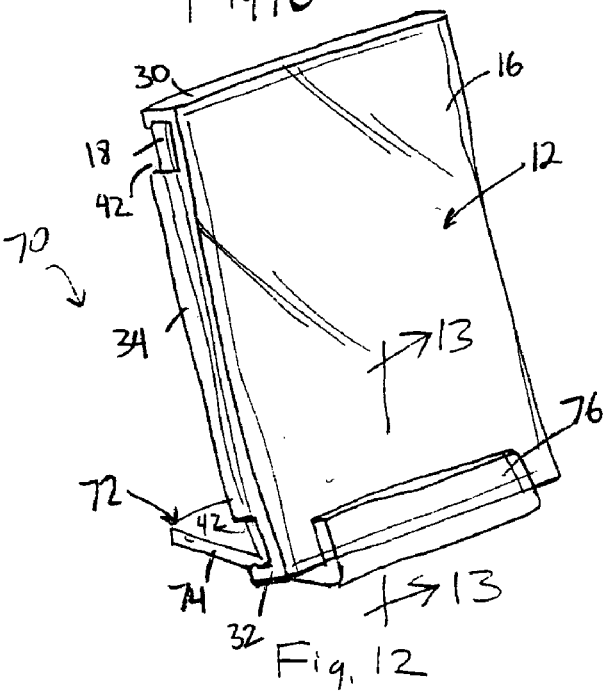
FIG. 12 is a front perspective view of the frame in accordance with the invention shown in a portrait mode in yet another alternative base.
Figure 13:
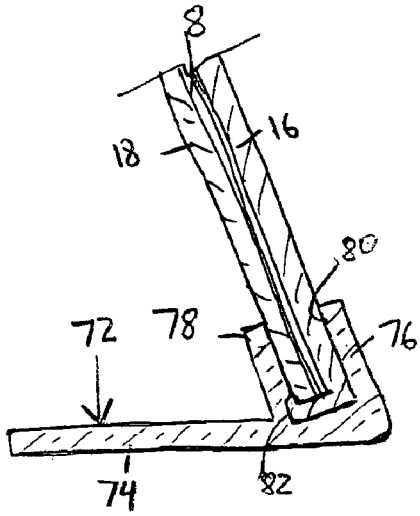
FIG. 13 is a cross-sectional view taken along the line 13-13 of FIG. 12.

Referring now to FIGS. 12 and 13, in this embodiment, the frame assembly 70 includes a frame 12 as described above and a base 72 having a substantially planar lower surface which is designed to rest on a planar support to support the frame 12 in a vertical, upright position. The planar lower surface is defined by a support wall 74 and the base 72 further includes two parallel retaining walls 76, 78 extending upward from the upper surface of the support wall 74 and defining a channel 80 therebetween receivable of an edge portion of the frame 12.

A first one of the retaining walls 76 is formed in connection with the front longitudinal edge of the support wall 74 and is angled rearward, i.e., toward the other, rear longitudinal edge. The second retaining wall 78 is arranged inward from the first retaining wall 76 and is also angled rearward. In view of the rearward orientation of the retaining walls 76, 78, the frame 12 will be angled rearward when positioned in the channel 80 in the base 72 (see FIG. 13).

The edges of the frame 12 and the retaining walls 76, 78 are preferably designed to enable the frame 12 to be securely yet removably fastened in the channel 80 defined between the retaining walls 76, 78. To this end, a snap-fit recess 82 is formed on an inward surface of the second retaining wall 78 at a position at which it receives the extension portion 36 of a retaining member 32 on the edge of the frame 12 when the frame 12 is positioned in the channel 80 to thereby secure the edge of the frame 12 in the snap-fit recess 82 (see FIG. 13). To remove the frame 12 from the base 72, the frame 12 is pivoted rearward (to the left in FIG. 13).

As shown in FIGS. 12 and 13, the frame 12 is rectangular and is positioned in the base 72 in a portrait mode in which a smaller edge of the frame 12 is positioned in the channel 80. However, it is also possible to positioned the frame 12 in the base 72 in a landscape mode in which a larger edge of the frame 12 is positioned in the channel 80.

Figure 14:
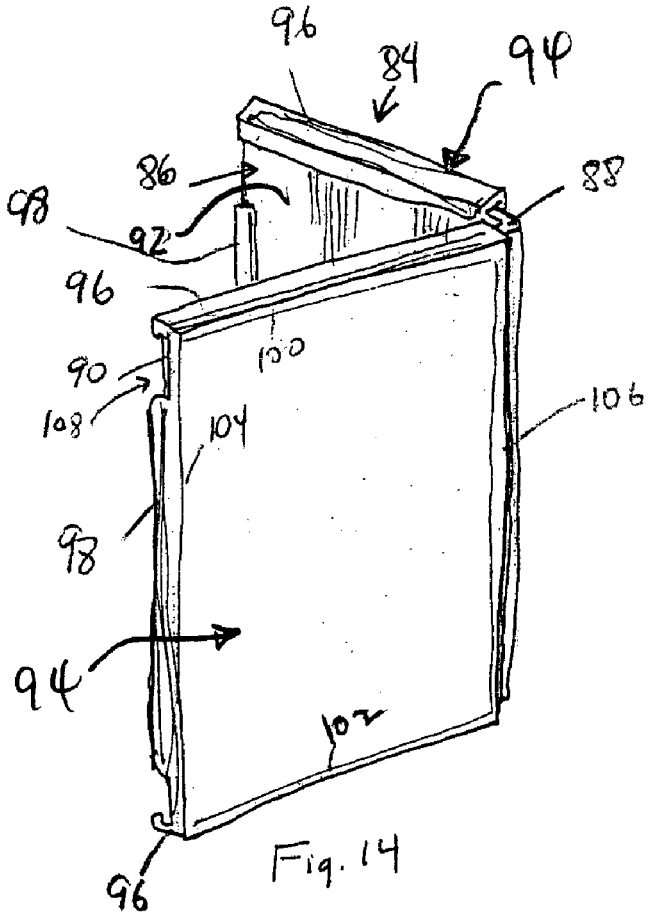
FIG. 14 is a front perspective view of another embodiment of a frame in accordance with the invention shown in a portrait mode.
Figure 15:
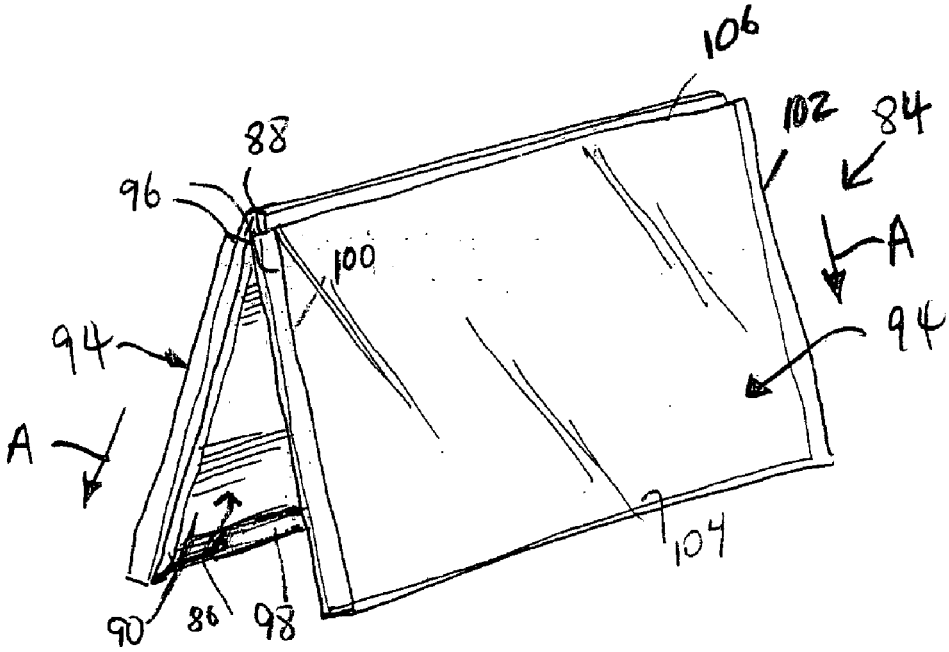
FIG. 15 is a front perspective view of the embodiment of the frame shown in FIG. 14 in a landscape mode.
Figure 16:
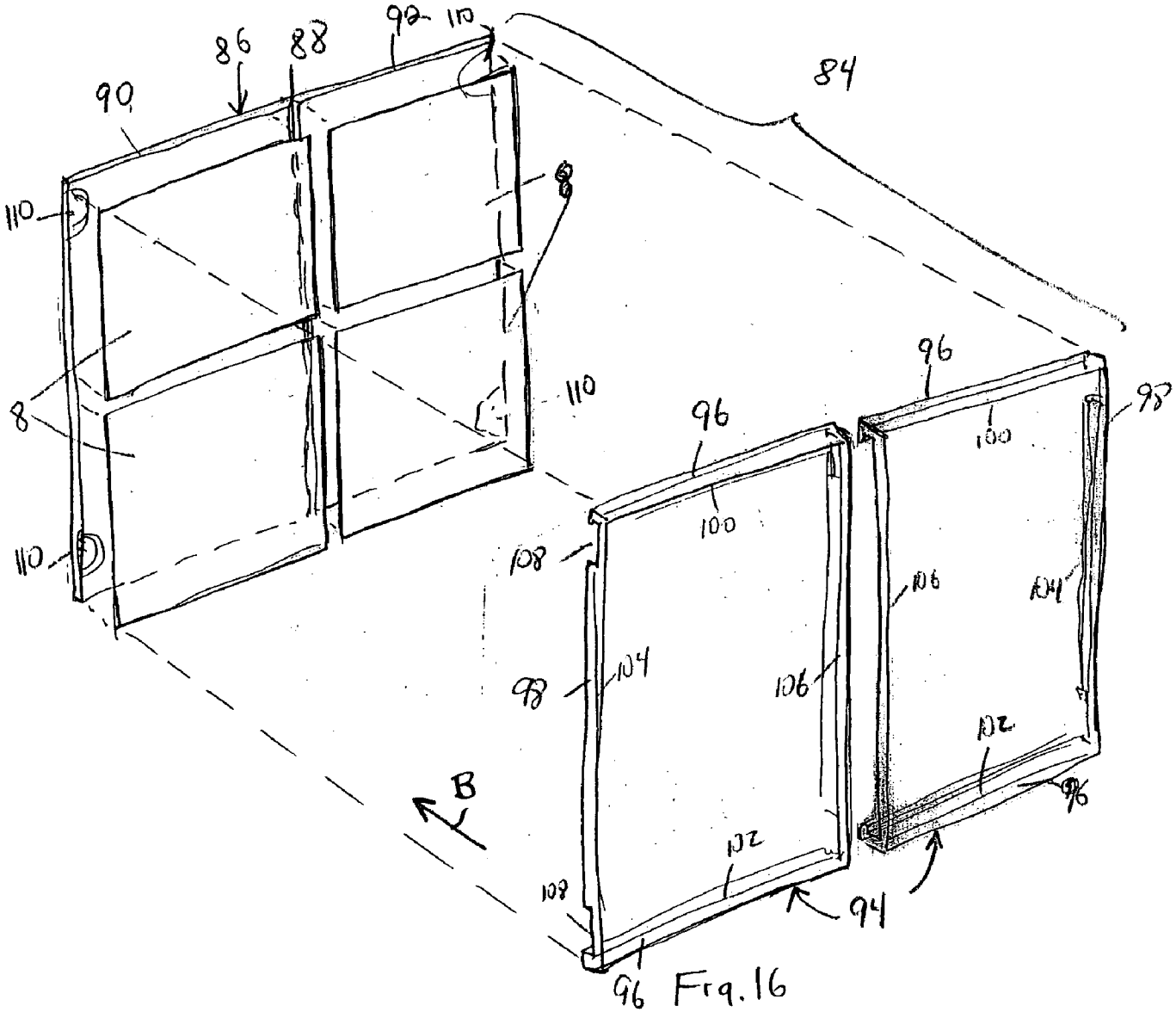
FIG. 16 is an exploded perspective view of the frame shown in FIG. 14.

Referring now to FIGS. 14-16, an embodiment of a frame 84 in accordance with the invention is shown wherein the frame 84 serves as its own base, i.e., is self-supporting, and thus a separate base is not required. Specifically, the frame 84 comprises a rear panel 86 which flexes about a score or fold (bending) line 88 to form two rear panel sections 90, 92, one on each side of the score or fold line 88. A front panel 94 is engaged with each rear panel section 90, 92. Each front panel 94 includes has a planar portion 96 defining a transparent window through which one or more pictures 8 mounted between the front panel 94 and rear panel section 90, 92 and facing the front panel 94, will be visible.

The rear panel 86 may be made of an opaque material. However, it is also conceivable that one or more of the rear panel sections 90, 92 has a planar portion defining a transparent window so that pictures can be placed in the frame 84 facing both forward and rearward and be visible through either the rear panel 86 or the front panel 94. In this case, the front-panels 94 can be made of an opaque material.

Each front panel 94 includes retaining members 96 extending across the upper and lower edges 100, 102, of the planar portion and a retaining member 98 extending across a middle portion of one lateral edge 104 of the planar portion. A retaining member is not formed along one lateral edge 106 of the planar portion adjacent the score line or bending line 88 (see FIG. 16). Retaining members 96, 98 may be as described above.

The retaining member 98 on the lateral edge 104 of each of the front panels 94 does not extend across the entire length thereof. Rather, as shown in FIGS. 14 and 16, the retaining member 98 is distanced or spaced from the upper and lower edges 100, 102 of the front panel a sufficient distance to allow access to the rear panel section 90, 92 for the purpose of enabling the rear panel 86 to be lifted or pried away from the front panel. Access openings 108 are thus formed along the edges of the frame 84 (see FIG. 16). Adjacent the access openings 108, the rear panel is preferably formed with fingernail or fingertip grips 110 (see FIG. 16).

To remove the front panels 94 and rear panel sections 90, 92 from engagement with one another, i.e., to insert or change pictures 8 therebetween, a person would place his or her finger in an access opening 108 with their hands on the retaining members 96, 98 adjacent to the access opening 108 and their fingernail or fingertip preferably in the associated fingernail or fingertip grip 110. By lifting the rear panel section 90, 92 upward away from the front panel 94 and pressing the adjacent retaining walls 96, 98 downward, the rear panel section 90, 92 can be separated from the front panel 94. The edges of the rear panel section 90, 92 are gradually removed from engagement with the retaining members 96, 98 as the separation of the rear panel section 90, 92 from the front panel 94 progresses, until the rear panel section 90, 92 becomes completely free of the front panel 94.

An alternate and possibly easier manner to remove the front panels 94 from engagement with the rear panel sections 90, 92 would be to slide the front panels 94 in a direction away from the score line 88, i.e. in the direction of arrows A in FIG. 15, so that the rear panel section 90, 92 slides relative to the edge of the front panel 94 without the retaining member.

The front and rear panels in the embodiment of FIGS. 14 and 15 can be engaged in the opposite manner as described in the preceding paragraph. That is, the item to be displayed is put in place, and the front panel sections 94 are slid over the rear panel sections 90, 92 respectfully, in a direction opposite to a direction of arrows A in FIG. 15.

The engagement/disengagement technique of sliding the members relative to each other, as described above with respect to FIGS. 14 and 15, can also be used in a single panel arrangement. That is, the frame would constitute only one rear panel section 90 or 92, only one front panel section 94 and edge retaining member on only three edges of the front (or rear) panel. The front and rear panels can be engaged or disengaged by relative sliding, in the same way as discussed above with respect to the double panel unit.

As shown in FIG. 16, the panels 94 can be engaged over the rear panel sections 90, 92 by snapping engagement by moving the panels 94 in the direction of the arrow B in FIG. 16 to engage a panel 94 with a rear panel section 90, 92, with an item to be displayed 8 interposed therebetween. The panels can be separated in the same way as the panels shown in FIGS. 1-9, by either manual separation with a fingertip, or flexing the panels to separate them, as described hereinabove.

If the rear panel 90, 92 is flexible, the score or fold line 88 is not needed and can be dispensed with.

In the embodiment shown in FIGS. 14-16, the front panels 94 and rear panel sections 90, 92 of the frame 84 are rectangular and the upper and lower edges thereof are smaller than the lateral edges thereof. When the frame is positioned as shown in FIG. 14 with the retaining members 96 along the smaller upper or lower edge in contact with the support surface, the frame 84 is positioned in a "portrait mode". When the frame 84 is positioned as shown in FIG. 15 with the retaining members 98 along the larger lateral edges in contact with the support surface, the frame 84 is positioned in a "landscape mode". Thus, it is an advantage of the invention that the same frame 84 can be used for the same size picture in either a portrait or landscape orientation.

Referring now to FIGS. 17-21, another embodiment of a frame 112 in accordance with the invention is shown wherein the frame 112 serves as its own base, i.e., is self-supporting, and thus a separate base is not required. The frame 112 comprises a front panel 114 as in the embodiment described above with respect to FIGS. 1-9 and a substantially planar rear panel 116 which includes an integral support mechanism. Specifically, the rear panel 116 has a substantially triangular prop 118*a*, 118*b* formed along each of the lower side and a lateral side of the rear panel 116. Each prop 118*a*, 118*b* is pivotable about a fold or score line 120, away from the front panel 114 when the rear panel 116 is engaged with the front panel 114, to form a support for the frame 112 (see FIG. 17).

Although triangular props 118*a*, 118*b* are shown, the props can have other forms so long as a contact point support 126 is provided at a distance from the front panel 114. In this manner, the frame 112 will be supported by the point contact support 126 provided by the prop 118*a*, 118*b* and by the retaining member 122, 124 formed along the lower edge of the front panel 114.

Figure 17:
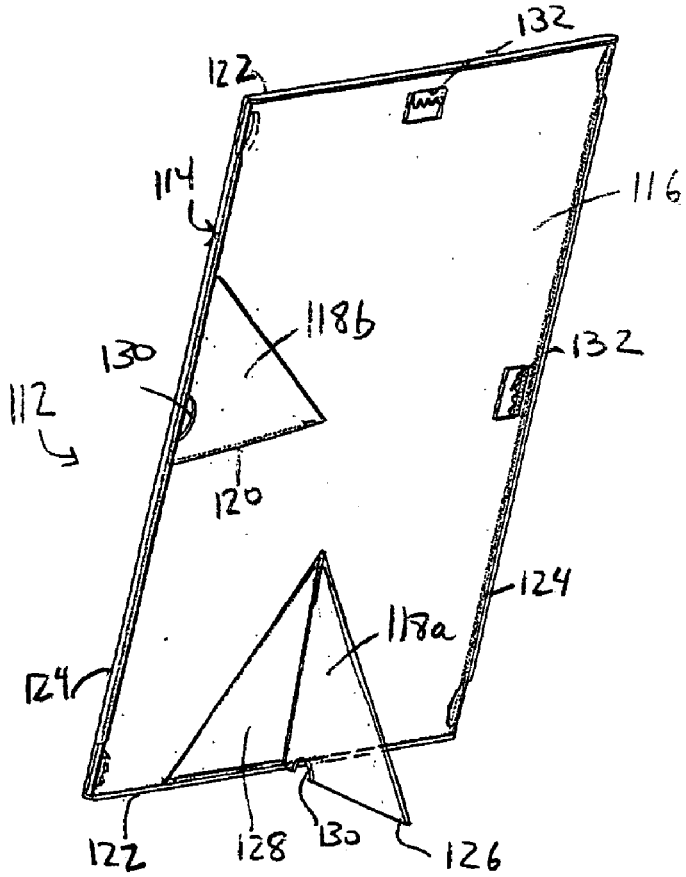
FIG. 17 is a rear perspective view of another embodiment of a frame in accordance with the invention shown in a portrait mode.
Figure 18:
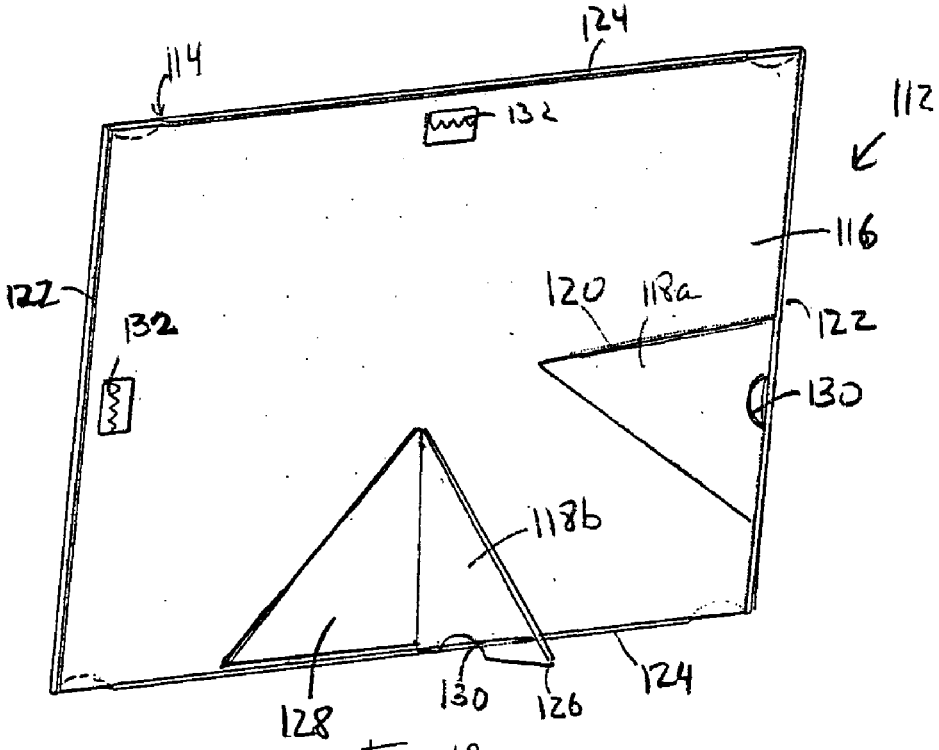
FIG. 18 is a rear perspective view of the frame shown in FIG. 17 in a landscape mode.
Figure 19:
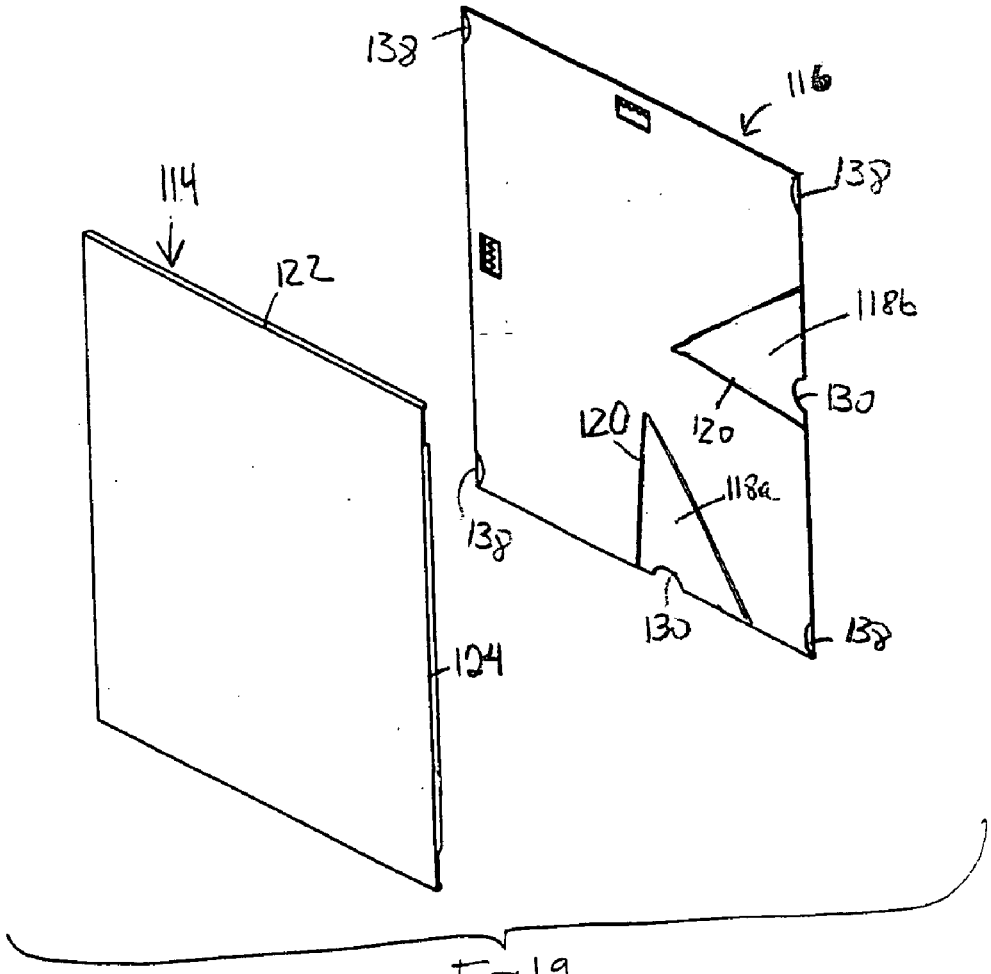
FIG. 19 is an exploded view of the frame shown in FIG. 17.
Figure 20:
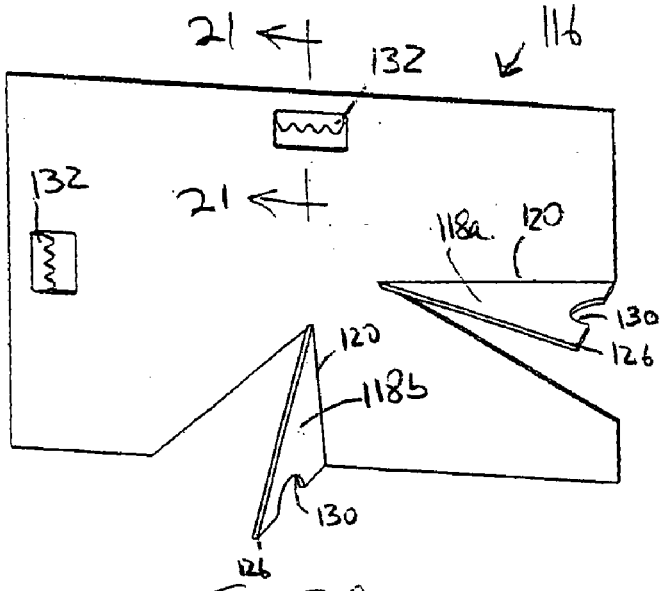
FIG. 20 is a rear perspective view of the rear panel of the frame shown in FIG. 17.
Figure 21:
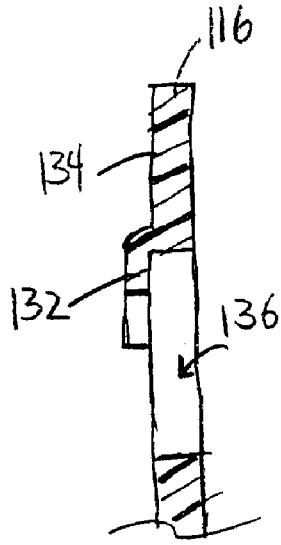
FIG. 21 is a cross-sectional view taken along the line 21-21 of FIG. 20.

When not being used, each prop 118*a*, 118*b* is situated in a position in which it is flush with a remaining, substantially planar portion of the rear panel 116 (see prop 118*b* in FIG. 17 and prop 118*a* in FIG. 18). In the non-use position, the prop 118*a*, 118*b* remains in position as it is snapped into and received between the ridge of the retaining member 122, 124 and the rear surface 128 of the front panel 114.

To enable each prop 118*a*, 118*b* to be pivoted outward, a cut-out 130 is formed in each prop 118*a*, 118*b*. As such, it is possible to insert a fingernail between the prop 118*a*, 118*b* and the front panel 114 in order to pry the prop 118*a*, 118*b* away from the front panel 114.

The rear panel 116 also includes integrally formed wall mounts 132 arranged opposite the props 118*a*, 118*b*. Each wall mount 132 constitutes a projection extending outward from the rear surface 134 of the rear panel 116 over an opening 136 in the rear panel 116 and having an undulating form (see FIGS. 20 and 21). Thus, every side of the rear panel 116 has a mounting or supporting mechanism, i.e., the upper side and right side include wall mounts 132 whereas the lower side and the left side include props 118*a*, 118*b* (see FIG. 17).

The wall mounts 132 can be formed in the rear panel 116 alone or together with the props 118*a*, 118*b*. Also, the rear panel as in any of the embodiments above can also be provided with one or more props and/or wall mounts.

The rear panel 116 also include fingernail grips 138 to enable separation of the rear panel 116 from the front panel 114 in the manner described above with respect to FIGS. 1-9.

In the embodiment shown in FIGS. 17-21, the front and rear panels 114, 116 of the frame 112 are rectangular and the upper and lower edges thereof are smaller than the lateral edges thereof. When the frame 112 is positioned as shown in FIG. 17 with the prop 118*a* along the lower side projecting outward and designed to contact the support surface, the frame 112 is positioned in a "portrait mode". When the frame 112 is positioned as shown in FIG. 18 with the prop 118*b* along the lateral side projecting outward and designed to contact the support surface, the frame 112 is positioned in a "landscape mode". Thus, it an advantage of the invention that the same frame 112 can be used for the same size picture in either a portrait or landscape orientation.

Figure 24:
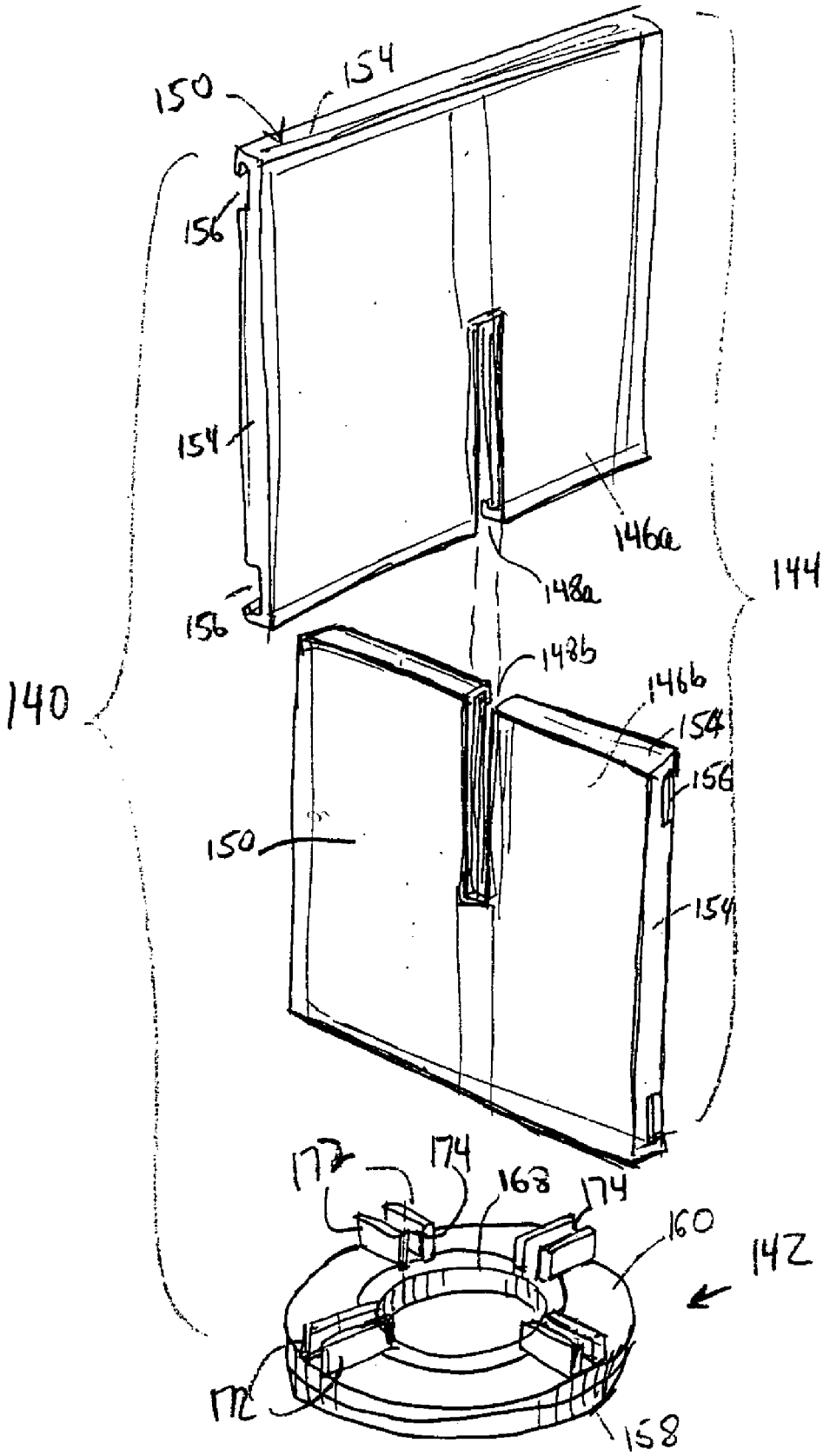
FIG. 24 is an exploded perspective view of the frame and base shown in FIG. 22.

Referring now to FIGS. 22-25, the frame assembly in accordance with this embodiment is designated generally as 140 and includes a base 142 and an X-shaped frame 144 rotatable on the base 142. The X-shaped frame 144 comprises two frame sections 146*a*, 146*b* as shown in FIG. 24 each defining a space for receiving pictures 8. Each frame section 146*a*, 146*b* is substantially similar to the frame 12 described above with respect to FIGS. 1-9 with the primary exception of cooperating slots 148*a*, 148*b*.

Figure 25:
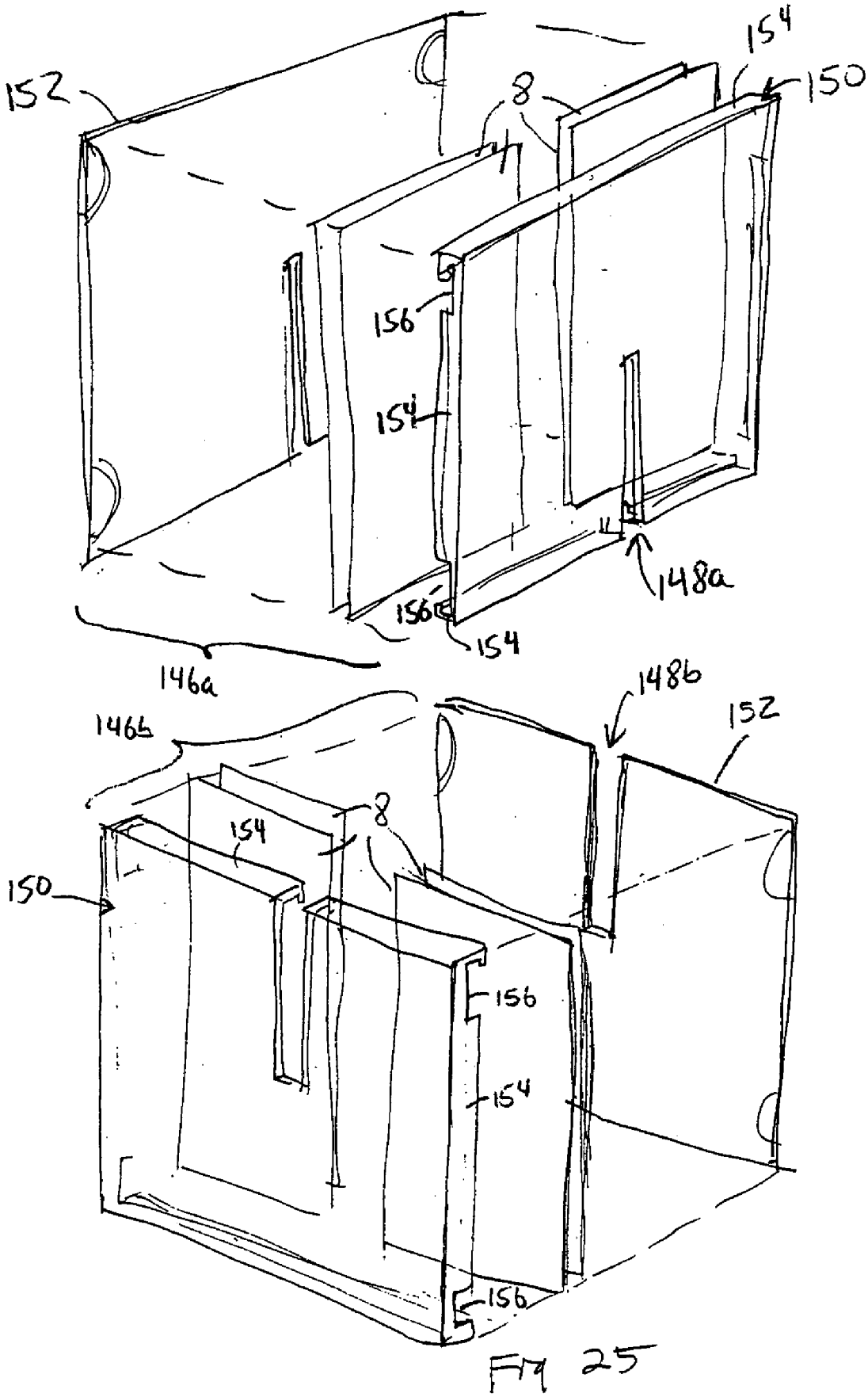
FIG. 25 is a further exploded perspective view of the frame shown in FIG. 22.

Specifically, frame section 146*a* includes a slot 148*a* extending upward from a lower edge, through both the front panel 150 and the rear panel 152 of the frame section 146*a*, whereas frame section 146*b* includes a slot 148*b* extending downward from an upper edge, through both the front panel 150 and the rear panel 152 of the frame section 146*b*. As such, the front and rear panels 150, 152 each include a slot as shown in FIG. 25.

Retaining members 154 are thus formed on the upper, lower and lateral edges of the front panel 150. At least one of the retaining members 154 does not extend across the entire edge of the front panel 150 to thereby define access openings 156 to enable disengagement of the rear panel 152 from the front panel 150. Retaining members are not formed on the edges of the front panel 150 where the slots 148*a*, 148*b* are situated. The pictures 8 can be placed into the frame sections 146*a*, 146*b* in the same manner as described above for the frame 12.

The formation of the slots 148*a*, 148*b* enables the frame sections 146*a*, 146*b* to mate with each other to form the X-shaped frame 144 (see FIG. 24). Specifically, the frame section 146*a* is slid over the frame section 146*b* so that the slot 148*a* receives a portion of the frame section 146*b* between the edge of the slot 148*b* and the lower edge of the frame section 148*b* while at the same time, the slot 148*b* receives a portion of the frame section 146*a* between the edge of the slot 148*a* and the upper edge of the frame section 146*a*.

The front and rear panels 150, 152 each include planar portions defining transparent windows so that pictures 8 in the frame 144 can be viewed through both the front and rear panels 150, 152. In this case, it becomes possible to place up to eight pictures 8 in the frame 144. As shown in FIG. 25, four pictures will be situated in frame section 146*a*, with two pictures facing the front panel 150 thereof and one on each side of the slot 148*a* whereas two other pictures face the rear panel 152 thereof with one picture on each side of the slot 148*a*. Four pictures can also be arranged in frame section 148*b*, with two facing the front panel 150 thereof and one on each side of the slot 148*b* whereas two other pictures face the rear panel 152 thereof with one picture on each side of the slot 148*b*.

The base 142 comprises a substantially circular lower support 158, a substantially circular upper support 160 spaced from the lower support 158 to define a cavity 162 therebetween. A ring 164 retaining a plurality of ball bearings 166 is movably arranged in the cavity 162 between the upper and lower supports 158, 160. An inner ring 168 is attached to the upper support 160 and is movable relative to the lower support 158 so that the upper support 160 and lower support 158 can rotate relative to one another about the ball bearings 166 in the retaining ring 164. Feet or pads 170 are arranged on the lower support 158 to support the base 142 above a support surface such as a desktop or the like. The ball bearings 166 can be eliminated so that the upper support 160 is only slideably mounted to lower support 158. Since the members are light in weight, sliding friction between upper and lower supports 158, 160 would not be objectionable.

Figure 22:
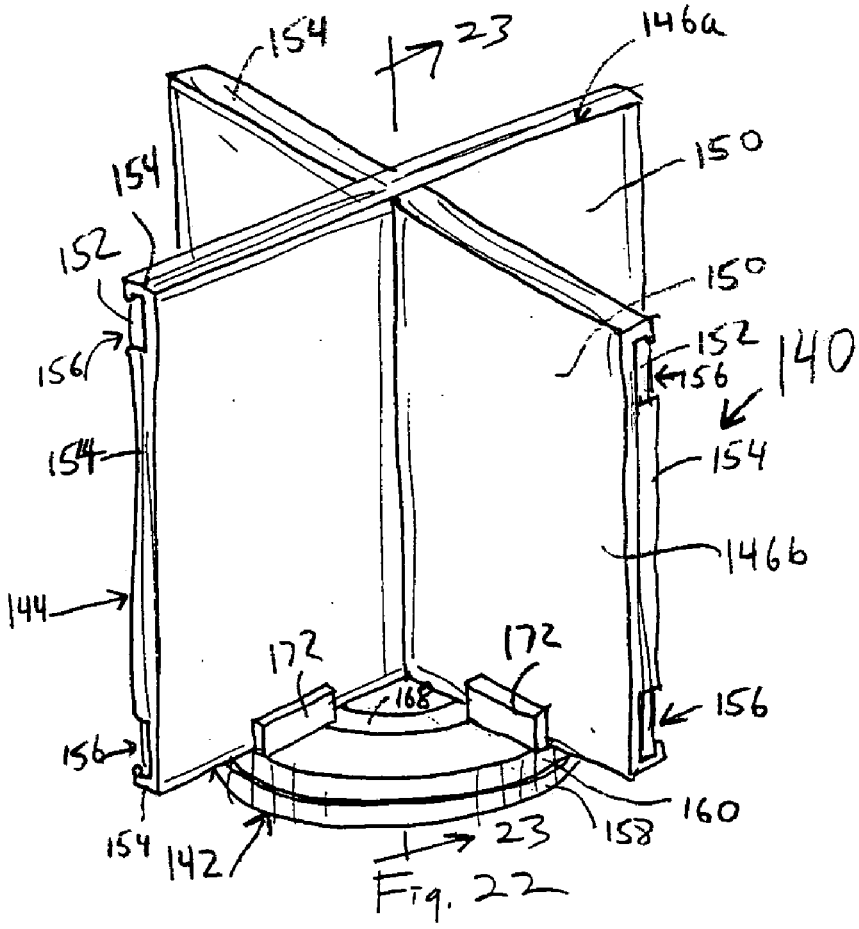
FIG. 22 is a perspective view of another embodiment of a frame in accordance with the invention shown in a detachable base.
Figure 23:
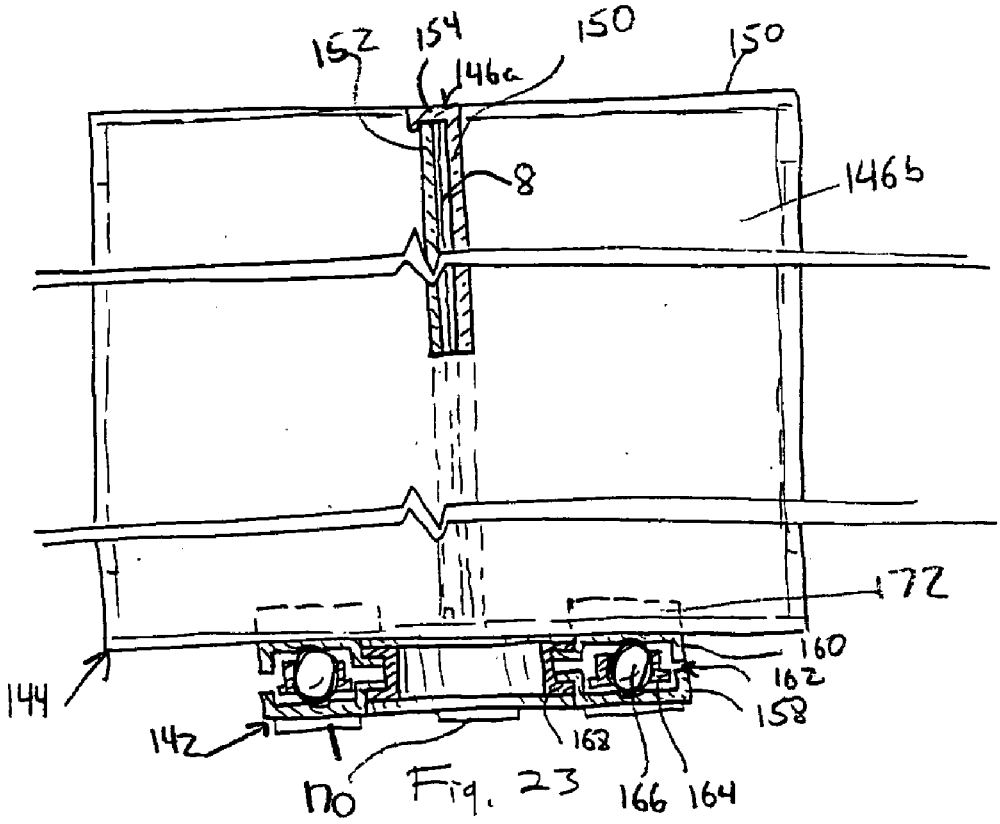
FIG. 23 is a cross-sectional view taken along the line 23-23 of FIG. 22.

Pairs of opposed retaining walls 172 are formed on the upper surface of the upper support 160 to define channels 174 therebetween capable of receiving edge portions of the frame 144 (see FIG. 22).

The frame 144 can be removed from engagement with the base 142 when it is desired to insert or remove pictures from the frame 144. The frame 144 is also rotatable relative to the base 142 to allow all of the pictures to be alternatingly viewed.

Figure 26:
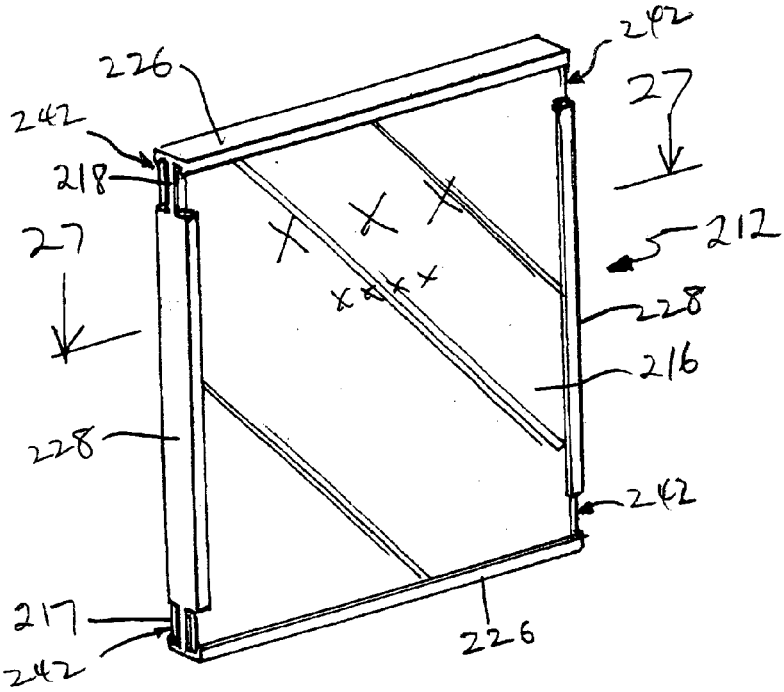
FIG. 26 shows a modified embodiment of the invention with removable panels on both the front and rear of the frame.
Figure 27:
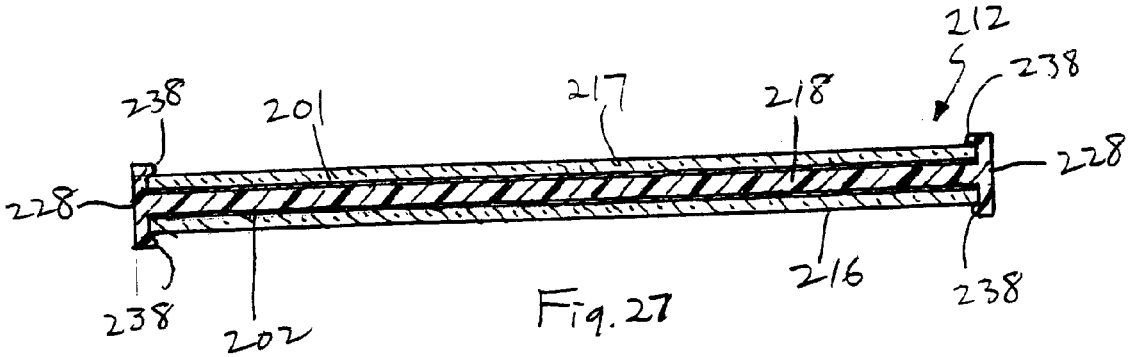
FIG. 27 is a cross-sectional view taken along the line 27-27 of FIG. 26.

The frame 212 of FIGS. 26 and 27 is similar to the frames shown in FIGS. 1-9 except that retaining members 26 of FIGS. 1-9 are extended so as to project from both opposite sides of a center panel member 218, and side engagement or retain members 28 project both forwardly and rearwardly of center panel number 218, as clearly seen in FIGS. 26 and 27. As shown in FIG. 27, the side engagement or retaining members 28 included ridges 238 which are similar to the ridges 38 of FIGS. 1-9, and which extends inwardly. The ridges 38 are spaced from the center panel 218 by a distance substantially equal to or only slightly larger than the thickness of a rear or front panel 216, 217, such that pictures or other display item 201, 202 can be mounted between the center panel 218 and one or both of the outer panels 216, 217 as shown in FIG. 27. The display panels 216, 217 fits snugly between the ridges 38 and the respective opposite surfaces of center panel 218 with only a nominal clearance for the thickness of the pictures or the like. Access openings 242 are provided at the top and bottom portions of the side edges of the frame, and a manner similar to access openings 42 shown in FIGS. 1-9. Fingernail or fingertip grips are provided, as may be desired, in the same manner as fingernail or fingertip grips 44 shown in FIGS. 4 and 9.

Preferably, the center panel 218 is opaque or dark in color, and outer panels 216, 217 are transparent so that pictures or other items can be viewed there through, from both opposite sides of the display unit.

The outer panels 216, 217 are removed in the same way as in the embodiment of FIGS. 1-9, by grasping corners and pulling outwardly, or by flexing, when the panels 216, 217 and 218 are made of flexible or resilient material.

It should be clear that various modifications and alterations can be made within the scope of the present invention. For example, in the embodiments of FIGS. 1-9, a single pair of retaining members 26 or 28 can be used. In such a case if only retaining members 26 are used, engagement between the front and rear panels is only along the top and bottom. If only side retaining members 28 are used, they can extend along the complete side and no engagement takes place along the top and bottom edges. The embodiment of FIGS. 16-18 can have a third (or more) panel(s) between the two shown panels, the intermediate panels having only top and bottom retaining member 96. Various features of one embodiment can be combined with features of other embodiments, consistent with proper operation thereof, within the scope of the present invention.

I claim:

1. A frame assembly for at least one object to be displayed, comprising:

a frame including a retaining panel and a rear panel, said retaining panel being spaced from at least part of said rear panel to define a space therebetween for receiving an object to be displayed, at least one of said retaining panel and said rear panel having a transparent area for viewing said at least one object, said retaining panel having a substantially planar portion and retaining members formed along edges of said retaining panel, each of said retaining members including an extension portion extending rearward relative to said substantially planar portion and a projecting ridge formed on said extension portion and extending inwardly, part of said rear panel being arranged to fit between said ridges and a rear surface of said retaining panel; and a base for supporting said frame in a substantially upright position, said base comprising a support wall and spaced-apart, parallel retaining walls extending upward from an upper surface of said support wall and defining a channel therebetween receivable of an edge portion of said frame, and securing means for removably securing said frame to said base, said securing means comprising a snap-fit rib formed on an inward surface of one of said retaining walls facing the other of said retaining walls at a position at which it engages a rear edge of said extension portion of one of said retaining members on said edge portion of said frame when said frame is positioned in said channel.

2. A frame assembly for at least one object to be displayed, comprising:

a frame including a retaining panel and a rear panel, said retaining panel being spaced from at least part of said rear panel to define a space therebetween for receiving an object to be displayed, at least one of said retaining panel and said rear panel having a transparent area for viewing said at least one object, said retaining panel having a substantially planar portion and retaining members formed along edges of said retaining panel, and each of said retaining members including an extension portion extending rearward relative to said substantially planar portion and a projecting ridge formed on said extension portion and extending inwardly, part of said rear panel being arranged to fit between said ridges and a rear surface of said retaining panel; and a base for supporting said frame in a substantially upright position, said base defining a channel receivable of an edge portion of said frame, said frame being removably attachable to said base, said base having a substantially semi-cylindrical form and comprises a pair of arcuate walls having substantially flat lower edges co-planar with one another and upper edges situated opposite one another to define said channel therebetween, and side walls connected to lateral edges of said arcuate walls, said side walls having substantially flat lower edges co-planar with said lower edges of said arcuate walls to provide a flat support surface to enable said base to be supported on a planar support, said side walls each including a cut-out arranged to accommodate said edge portion of said frame, said cut-outs each including a snap-fit portion arranged to receive said ridge and an adjoining portion of said extension portion of one of said retaining members in said edge portion of said frame when said edge portion of said frame is positioned in said channel to thereby secure said retaining member at least partially between said snap-fit portion and a bottom surface of said cut-out.

3. A frame assembly for at least one object to be displayed, comprising:

a frame including a retaining panel and a rear panel, said retaining panel being spaced from at least part of said rear panel to define a space therebetween for receiving an object to be displayed, at least one of said retaining panel and said at least part of said rear panel having a transparent area for viewing said at least one object;

said retaining panel having a substantially planar portion defining a plurality of edges and retaining members formed along all of said edges of said retaining panel, first and second ones of said retaining members extending across the entire length of first and second opposed edges of said retaining panel; and each of said retaining members including an extension portion extending rearward relative to said substantially planar portion and a projecting ridge formed on said extension portion and extending inwardly, said ridges on said first and second retaining members extending across the entire length of said first and second retaining members, part of said rear panel being arranged to fit between said ridges and a rear surface of said retaining panel.

4. A frame assembly for at least one object to be displayed, comprising:

a frame including a retaining panel and a rear panel, said retaining panel being spaced from at least part of said rear panel to define a space therebetween for receiving an object to be displayed, at least one of said retaining panel and said at least part of said rear panel having a transparent area for viewing said at least one object;

said retaining panel having a substantially planar portion defining a plurality of edges and retaining members arranged on all of said edges, only one of said retaining members being situated on each edge, said retaining members each extending along a major portion of the respective one of said edges; and each of said retaining members including an extension portion extending rearward relative to said substantially planar portion and a projecting ridge formed on said extension portion and extending inwardly, part of said rear panel being arranged to fit between said ridges and a rear surface of said retaining panel, said retaining member along a first one of said edges extending to an adjacent second one of said edges and said retaining member along said second edge being spaced from said retaining member along said first edge to thereby define an access opening between said retaining members along said first and second edges.

5. A frame assembly for at least one object to be displayed, comprising:

a frame including a retaining panel and a rear panel, said retaining panel being spaced from at least part of said rear panel to define a space therebetween for receiving an object to be displayed, at least one of said retaining panel and said at least part of said rear panel having a transparent area for viewing said at least one object; and a support device arranged to support said frame in a substantially upright position, said support device comprising a base for supporting said frame, said base defining a channel receivable of an edge portion of said frame, said frame being removably attachable to said base, said retaining panel having a substantially planar portion defining a plurality of edges and retaining members arranged on all of said edges, only one of said retaining members being situated on each edge, said retaining members each extending along a major portion of the respective one of said edges, and each of said retaining members including an extension portion extending rearward relative to said substantially planar portion and a projecting ridge formed on said extension portion and extending inwardly, part of said rear panel being arranged to fit between said ridges and a rear surface of said retaining panel.

6. The frame assembly of claim 5, wherein said base comprises a support wall having a substantially planar lower surface adapted to rest on a support surface.

7. The frame assembly of claim 5, wherein said base comprises a support wall and spaced-apart, parallel retaining walls extending upward from an upper surface of said support wall and defining said channel therebetween.

8. The frame assembly of claim 7, wherein said base further includes securing means for removably securing said frame to said base.

9. The frame assembly of claim 8, wherein said securing means comprise a snap-fit rib formed on one of said retaining walls at a position at which it engages a rear edge of said extension portion of one of said retaining members on said edge portion of said frame when said frame is positioned in said channel, said snap-fit rib extending inwardly to face the other of said retaining walls.

10. The frame assembly of claim 8, wherein said securing means comprise a snap-fit recess formed on an inward surface of one of said retaining walls facing the other of said retaining walls at a position at which it receives said extension portion of one of said retaining members on said edge portion of said frame when said frame is positioned in said channel.

11. The frame assembly of claim 7, wherein a first one of said retaining walls is arranged at a longitudinal edge of said base and angled rearward and a second one of said retaining walls is arranged inward from said first retaining wall and angled rearward.

12. The frame assembly of claim 5, wherein said base has a substantially semi-cylindrical form and comprises a pair of arcuate walls having substantially flat lower edges co-planar with one another and upper edges situated opposite one another to define said channel therebetween, and side walls connected to lateral edges of said arcuate walls, said side walls having substantially flat lower edges co-planar with said lower edges of said arcuate walls to provide a flat support surface to enable said base to be supported on a planar support, said side walls each including a cut-out arranged to accommodate said edge portion of said frame.

13. The frame assembly of claim 12, wherein said cut-outs each include a snap-fit portion arranged to receive said ridge and an adjoining portion of said extension portion of one of said retaining members in said edge portion of said frame when said edge portion of said frame is positioned in said channel to thereby secure said retaining member at least partially between said snap-fit portion and a bottom surface of said cut-out.

14. The frame assembly of claim 4, wherein an edge of said rear panel is visible in said access opening and said access opening enables insertion of an object from a lateral direction between said retaining panel and said rear panel to lift said rear panel away from said retaining panel.

15. The frame assembly of claim 4, wherein both said retaining panel and said rear panel have transparent areas for viewing said at least one object to be displayed.

16. The frame assembly of claim 4, wherein said retaining and rear panels are substantially rectangular, and said retaining members extend along all four edges of said retaining panel with each of said retaining members extending only along a respective one of said edges, said retaining member along at least one of said edges of said retaining panel extending only across a portion of a length of said at least one edge of said retaining panel.

17. The frame assembly of claim 16, wherein said retaining member along said at least one edge is spaced from said retaining members along adjacent edges of said retaining panel to thereby define access openings between said retaining member along said at least one edge and said retaining members along said adjacent edges.

18. The frame assembly of claim 4, wherein said rear panel includes fingernail or fingertip grips alongside said access opening.

19. The frame assembly of claim 4, wherein said ridges are spaced from said rear surface of said retaining panel by a distance substantially equal to or only slightly larger than a thickness of said rear panel such that said rear panel fits between said ridges and said rear surface of said retaining panel with only a nominal clearance for a thickness of the object to be displayed.

20. The frame assembly of claim 4, further comprising a support device arranged to support said frame in a substantially upright position.

21. The frame assembly of claim 20, wherein said support device comprises at least one prop formed in connection with said rear panel along a respective side of said rear panel, each of said at least one prop being pivotable about a fold or score line in said rear panel between a first position in which said at least one prop is situated between said ridge of one of said retaining members and said rear surface of said retaining panel and a second position apart from said retaining panel to define a support surface at a distance from said retaining panel.

22. The frame assembly of claim 21, wherein said at least one prop comprises two substantially triangular props.

23. The frame assembly of claim 21, wherein said at least one prop is flush with a remaining portion of said rear panel when in said first position.

24. The frame assembly of claim 21, wherein each of said at least one prop includes a cut-out to enable pivotal movement of said at least one prop from the first position to the second position.

25. The frame assembly of claim 21, further comprising at least one wall mount integrally formed in said rear panel on a side of said rear panel without one of said at least one prop, each of said at least one wall mount including a projection extending outward from a rear surface of said rear panel.

26. The frame assembly of claim 4, further comprising at least one wall mount integrally formed in said rear panel on a side of said rear panel, each of said at least one wall mount including a projection extending outward from a rear surface of said rear panel.

27. The frame assembly of claim 4, wherein said rear panel has a score or fold line and is flexible about said score or fold line to thereby define first and second interconnected rear panel sections, one on each side of said score or fold line, said retaining panel being spaced from said first rear panel section, at least one of said retaining panel and said first rear panel section having a transparent area, said first rear panel section being arranged to fit snugly between said ridges of said retaining members on said retaining panel and a rear surface of said retaining panel, said frame further comprising an additional retaining panel spaced from said second rear panel section to define a space therebetween for receiving an object to be displayed, at least one of said additional retaining panel and said second rear panel section having a transparent area for viewing said at least one object, said additional retaining panel having a substantially planar portion and retaining members formed along edges of said additional retaining panel including at least two opposed edges of said additional retaining panel, each of said retaining members including an extension portion extending rearward relative to said substantially planar portion and a projecting ridge formed on said extension portion and extending inwardly, said second rear panel section being arranged to fit snugly between said ridges and a rear surface of said additional retaining panel, said retaining members on said retaining panels being formed along edges of said retaining panels not adjacent said score or fold line.

28. The frame assembly of claim 27, wherein said retaining member along at least one of said edges of each of said retaining panels extends only across a portion of a length of said at least one edge of said retaining panel and is spaced from said retaining members along any adjacent edges of said retaining panel to thereby define access openings between said retaining member along said at least one edge and said retaining members along said adjacent edges.

29. The frame assembly of claim 27, wherein said retaining panels are slidable over the respective one of said rear panel sections relative to said score or fold line.

30. The frame assembly of claim 27, wherein said retaining members are structured and arranged to enable said frame to be supported by said retaining members on a substantially flat support surface.

31. The frame assembly of claim 27, wherein said rear panel is substantially rectangular, and said retaining panels are each substantially rectangular.

32. The frame assembly of claim 4, further comprising:

a pair of said frames, each of said frames including cooperating slots to enable said frames to mate with one another to form an X-shape.

33. The frame assembly of claim 32, wherein a first one of said frames includes a slot extending upward from a lower edge through both said retaining and rear panels, and a second one of said frames includes a slot extending downward from an upper edge through both said retaining and rear panels.

34. The frame assembly of claim 32, wherein both said retaining and rear panels have transparent windows for viewing objects to be displayed.

35. The frame assembly of claim 32, wherein said retaining and rear panels are substantially rectangular and said retaining members extend along all four edges of said retaining panels, said retaining member along at least one of said edges of each of said retaining panels extending only across a portion of a length of said at least one edge of said retaining panel and being spaced from said retaining members along adjacent edges of said retaining panel to thereby define access openings between said retaining member along said at least one edge and said retaining members along said adjacent edges.

36. The frame assembly of claim 32, further comprising a base, and wherein said base comprises a plurality of pairs of opposed retaining walls each defining a channel receivable of an edge portion of a respective one of said frames to support said frame.

37. The frame assembly of claim 36, wherein said base further comprises a substantially circular lower support, a substantially circular upper support spaced from said lower support to define a cavity therebetween, a ring retaining a plurality of ball bearings movably arranged in the cavity between the upper and lower supports and an inner ring attached to said upper support and movable relative to said lower support such that said upper support and lower support can rotate relative to one another about said ball bearings in said retaining ring.

38. The frame assembly of claim 36, wherein said base further includes a lower support and an upper support rotatably connected to said lower support, said upper support defining said retaining walls.

39. The frame assembly of claim 4, further comprising:

a front panel spaced from said retaining panel to define a respective space therebetween for receiving an object to be displayed, at least one of said front and retaining panels having a transparent area for viewing an object;

each of said retaining members including a front extension portion extending forward relative to said substantially planar portion and a projecting ridge formed on said front extension portion and extending inwardly, said front panel being arranged to fit snugly between said ridges of said front extension portion and a front surface of said retaining panel.

40. The frame assembly of claim 39, wherein said retaining panel and said front and rear panels are all substantially rectangular, and said retaining members extend along all four edges of said retaining panel, said retaining member along at least one of said edges of said retaining panel extending only across a portion of a length of said at least one edge of said retaining panel.

41. The frame assembly of claim 40, wherein said retaining member along said at least one edge is spaced from said retaining members along adjacent edges of said retaining panel to thereby define access openings between said retaining member along said at least one edge and said retaining members along said adjacent edges.

42. The frame assembly of claim 41, wherein said front and rear panels each include fingernail or fingertip grips alongside said access openings.

43. The frame assembly of claim 39, wherein said ridges are spaced from surfaces of said front and rear panels by a distance substantially equal to or only slightly larger than a thickness of said front and rear panels such that said front and rear panels fit between said respective ridges and said retaining panel with only a nominal clearance for a thickness of the an object to be displayed.

44. The frame assembly of claim 39, further comprising a support device arranged to support said retaining, front and rear panels in an substantially upright position when said front and rear panels are engaged with said retaining panels.

* * * * *